United States Patent [19]

Wachtel, deceased et al.

[11] Patent Number: 4,924,547

[45] Date of Patent: May 15, 1990

[54] PACKAGEABLE TOILET UTENSIL

[75] Inventors: Jean Louis Wachtel, deceased, late of Selestat, France; by Tom Wachtel, heir, Greenville, R.I.; by Irene Wachtel, heir, Santa Fe, N. Mex.; by Susan Erny, heir, Guebwiller; by Dany Wachtel, heir, Selestat, both of France

[73] Assignee: Celluloid S.A., Selestat, France

[21] Appl. No.: 196,506

[22] Filed: May 20, 1988

[51] Int. Cl.[5] ..... A46B 17/00

[52] U.S. Cl. ..... 15/185; 15/144 R; 132/311

[58] Field of Search ..... 15/176.1, 144 R, 185; 401/191; 132/308, 310, 311, 314, 315

[56] References Cited

U.S. PATENT DOCUMENTS

| | | | |
|---|---|---|---|
| 396,898 | 1/1889 | Smith | 132/311 X |
| 666,360 | 1/1901 | Shearer | 15/185 |
| 835,365 | 11/1906 | Morgan | 15/185 |
| 1,104,365 | 7/1914 | Loughlin | 15/185 |
| 1,142,356 | 6/1915 | Nellany | 15/185 |
| 1,432,717 | 10/1922 | Miller | 15/184 |
| 2,678,459 | 3/1954 | Stuckey . | |
| 4,204,294 | 5/1980 | Halverson | 15/185 |

FOREIGN PATENT DOCUMENTS

| | | | |
|---|---|---|---|
| 1230365 | 3/1960 | France | 128/62 A |
| 431483 | 3/1948 | Italy | 15/185 |
| 288123 | 5/1953 | Switzerland . | |
| 279018 | 2/1927 | United Kingdom . | |

*Primary Examiner*—Harvey C. Hornsby
*Assistant Examiner*—K. O'Leary
*Attorney, Agent, or Firm*—Kenyon & Kenyon

[57] ABSTRACT

The present invention concerns a packageable toilet utensil comprising one handhold with two hollow bodies articulated with respect to each other, one open holder-forming body intended to receive at least a part of at least the active head of the utensil and one cover-forming body that may be folded on the holder-forming body, the active head carrying stem being mounted pivotally about a pivoting pin of the holder-forming body so as to occupy an active position in the prolongation of the holding-forming body in which position the stem and the active head are locked by folding of the cover-forming body.

6 Claims, 2 Drawing Sheets

PACKAGEABLE TOILET UTENSIL

BACKGROUND OF THE INVENTION

The present invention relates to a packageable toilet utensil, in particular to a tooth brush, i.e. a foldable utensil likely to be in the pocket-size form.

Toilet utensils such as a tooth brush have a relatively important length which does not allow them to be easily transported in a jacket- or trouser pocket. Moreover, it is necessary to transport the tooth brush in a relatively cumbersome protective holder which can be relatively easily lost.

SUMMARY OF THE INVENTION

The present invention has as an object to eliminate the above drawbacks of the known utensils by providing a packageable toilet utensil, such for example as a tooth brush, of the type comprising an active head solid with a handle consisting of a stem which carries the head and of a handhold connected to the stem so that the assembly formed of the head and of the stem is retractable into the handhold and characterized in that the handhold comprises two hollow bodies articulated with respect to each other, one body forming an open holder intended to receive at least a part of at least the head and one body forming a cover folding back on the holder-forming body and in that the stem is mounted in pivoting relationship about a pivoting pin of the holder-forming body in a plane perpendicular to the longitudinal median plane of this body so that the assembly formed of the stem and of the head can occupy an active position in the prolongation of the holder-forming body in which position the said assembly is locked by folding back the cover-forming body and an inactive retracted position after folding back of the cover-forming body.

An advantage of the utensil according to the invention is that it can be in a pocket-size form when not used. It is therefore very easily transportable and does not necessitate the use of an independent protective holder.

According to a feature of the invention, the cover-forming body comprises near its open free end two side walls for locking between them at least the end part of the stem in the aforesaid active and folded positions of the cover-forming body.

According to another feature of the invention, the pivoting pin of the aforesaid stem is arranged near the free end of the holder-forming body in the longitudinal median plane of the same and is solid with an even part of the said body serving as a support for the end part of the stem.

According to still another feature of the invention, the holder-forming body comprises at least one side opening for the passage of the aforesaid part of the head formed of brushing bristles when the utensil is a tooth brush.

According to still another feature of the invention, the stem comprises one side groove in which the aforesaid pivoting pin is inserted and which renders the assembly formed of the stem and of the head removable.

BRIEF DESCRIPTION OF THE DRAWINGS

For a fuller understanding of the invention, reference is made to the following description taken in conjunction with the accompanying drawings, in which:

FIG. 3 is a perspective view of the utensil in a position where the assembly formed of the stem and of the active head of the utensil is partly lodged inside the holder-forming body;

DESCRIPTION OF THE PREFERRED EMBODIMENT

Figures 1, 2, 4:
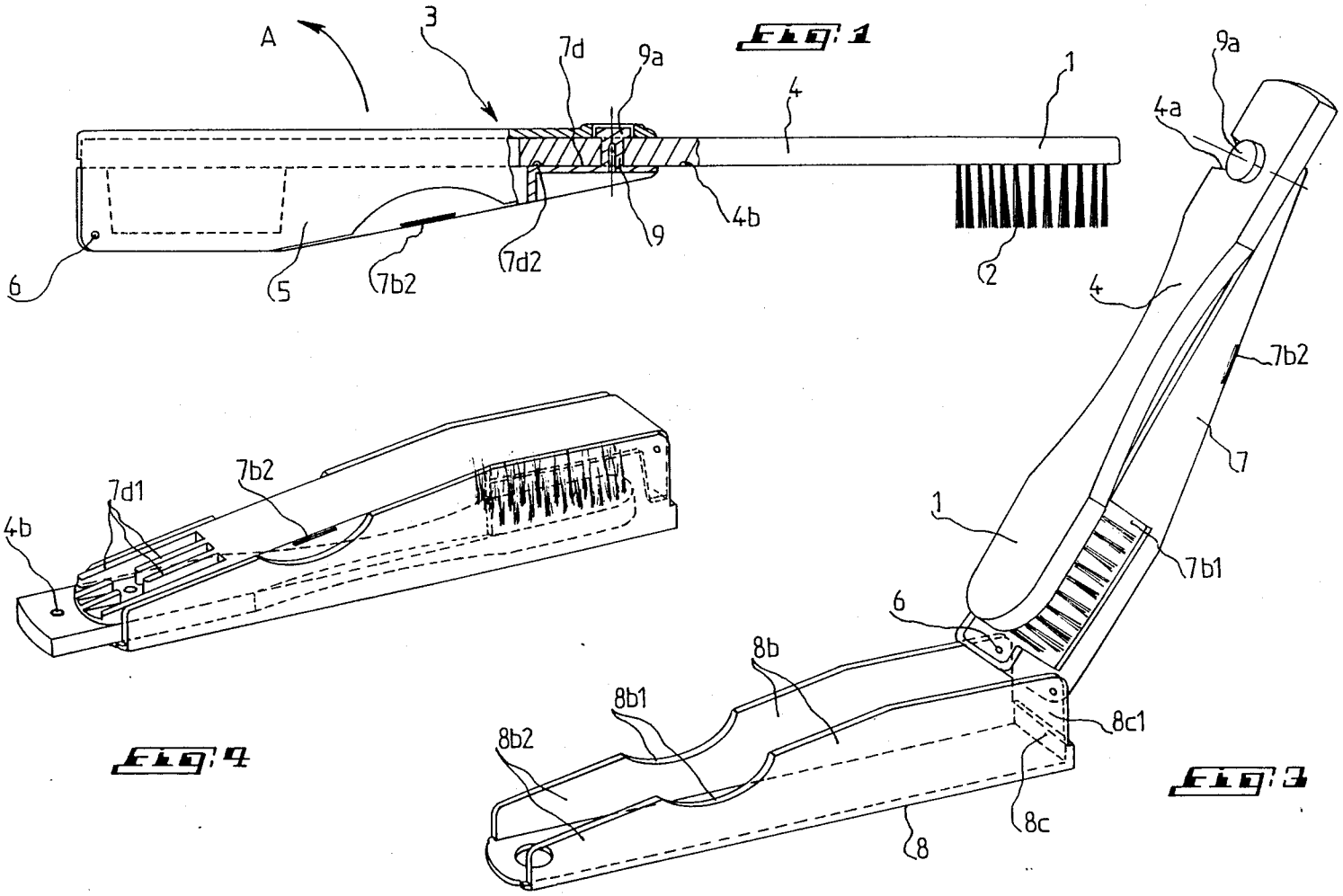
FIG. 1 is a view of the utensil of the invention in the active position with partial longitudinal cross-section.
FIG. 2 is a perspective view of the utensil in an unfolded position for unlocking the assembly formed of the stem and of the active head of the utensil.
FIG. 4 is a perspective view of the utensil in its totally folded back configuration.
Figure 2:
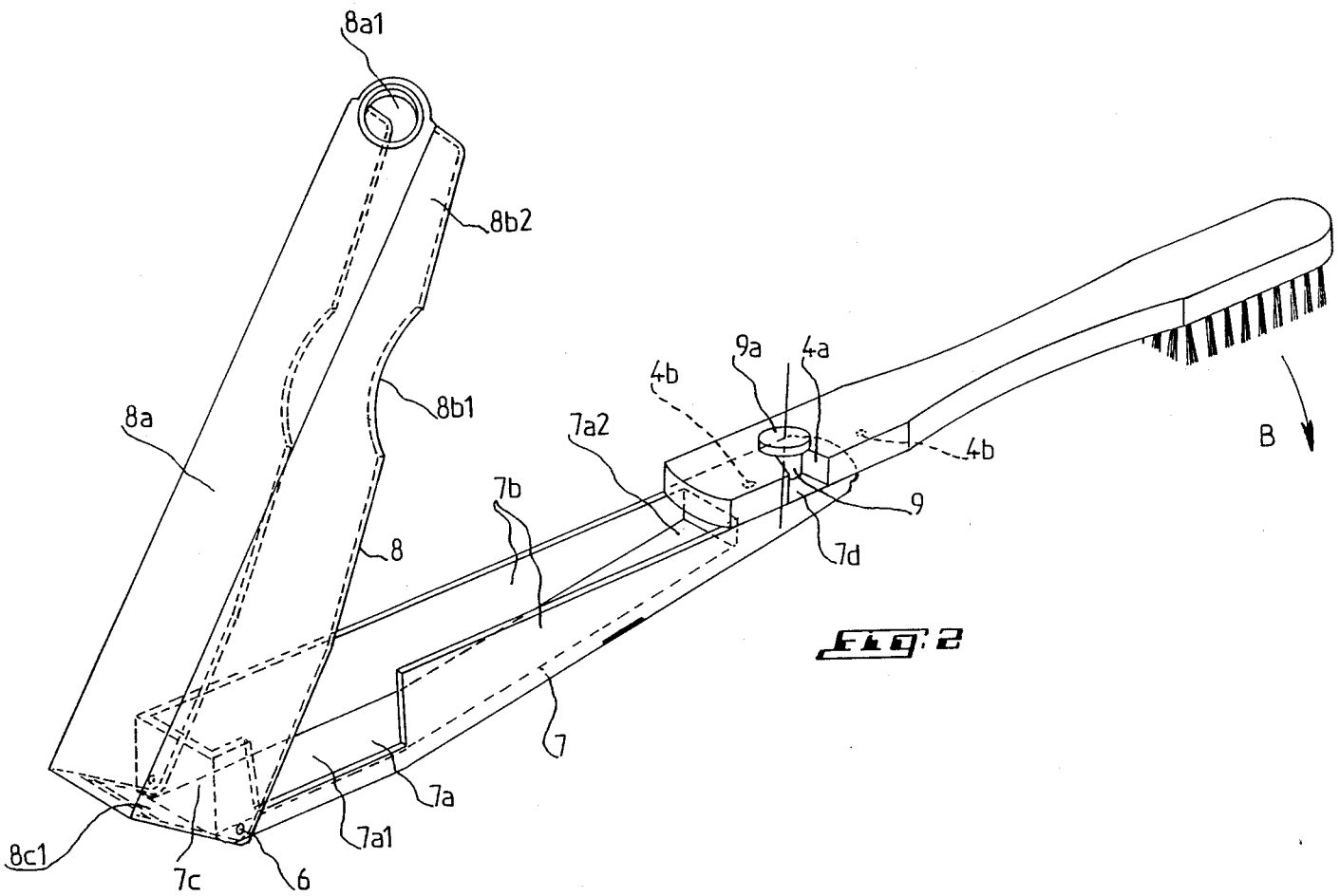

Referring to FIG. 1, the toilet utensil according to the invention, of the type of a tooth brush, comprises one active head-forming extreme part 1 provided with brushing bristles 2 and solid with a handle 3. The handle 3 is formed of a stem 4 which carries the head and of a handhold 5 connected to the stem 4 so that the assembly formed of the head 1 and of the stem 4 is retractable into the handhold 5 as will be described later.

As shown in FIGS. 2 and 3, the handhold 5 consists of two hollow bodies hinged with respect to each other about one hinge pin 6, one body 7 forming an open holder intended to receive at least the brushing bristles 2 and one body 8 forming a cover which can be folded on the holder-forming body 7. More precisely, the holder-forming body 7 consists of a bottom-forming wall *7a* and of two parallel side walls *7b* connected near the hinge 6 to the cover-forming body 8 by an end wall *7c*. The bottom-forming wall *7a* consists of the first wall part *7a*1 starting from the end wall *7c* and of a second wall part *7a*2 extending the first part *7a*1 upwardly so as to form an obtuse angle between them. Thus, each of the side walls *7b* comprises one approximately rectangular wall part starting from the end wall *7c* and ending near the connection of the wall parts *7a*1 and *7a*2 and one wall part in the shape of a right-angled triangle extending the rectangular part and whose hypotenuse consists of the edges of the ascending wall part *7a*2. One of the side walls *7b* comprises one opening *7b*1 formed in the rectangular part of the wall *7b* from the edge of the opening of the holder-forming body 7 and whose shape and dimension permit the brushing bristles 2 to go into and to come out of the body 7 respectively during the folding and the unfolding of the utensil. In the present case, the opening *7b*1 is in the shape of a rectangle with a length greater than that of the area occupied by the brushing bristles 2 and with a width slightly greater than the height of the bristles 2 starting from the head 1.

The stem 4 is mounted in pivoting relationship at its end part opposite to the active head 1 about a pivoting pin 9 solid with the end part of the holder-forming body 7 opposite to the end wall *7c*. The pivoting pin 9 is comprised in the longitudinal median plane of the holder-forming body 7 and is solid with an even wall *7d* defined between the side walls *7b* and level with the edges of the same. The even wall *7d* serves as a support surface for the even lower end part of stem 4 and extends on a relatively short distance between the side walls *7b*. This even wall *7d* defines under it a recessed part with a volume of a triangular right prism and comprising reinforcing ribs *7d*1. The pivoting pin 9 comprises at its free end a circular head *9a* for holding the end part of stem 4 against the even wall *7d* for supporting the body 7. The end part of the stem 4 comprises one side groove *4a* which is substantially transversal to the longitudinal axis of the stem 4-active head 1 assembly and in which the pivoting pin 9 is inserted. The shape of groove 4*a* can be adapted so as to make the stem 4-active head 1 assembly removable from body 7. The even support wall 7*d* comprises opposite to the free end of body 7 and along the longitudinal axis of same, one projection 7*d*2 co-operating with two corresponding recesses 4*b* under the end part of stem 4 along the longitudinal axis of the stem 4-active head 1 assembly in order to position this assembly respectively in the holder-forming body 7 and in the prolongation of the same before the cover-forming body 8 is folded back.

The cover-forming body 8 is defined by an upper wall 8a from which two parallel side walls 8*b* start which are separated from each other by a distance slightly greater than the distance between the side walls 7*b* of the holder-forming body 7 so that these walls 7*b* can be inserted into the cover-forming body 8 during the folding of the same onto the body 7. The lower edges of the side walls 8*b* have an outline which takes the exact outer shape of the bottom-forming wall 7*a* of body 7 in the folded position of the cover-forming body 8 on the body 7 as seen in FIGS. 1 and 4. The side walls 8*b* comprise two curvilinear recesses 8*b*1 disposed symetrically with respect to the longitudinal median plane of the cover-forming body 8 and co-operating with two side projections 7*b*2 in order to manually open the cover-forming body 8 from the active position of the utensil or from its totally folded back configuration. The extreme side walls 8*b*2 of the side walls 8*b* of the cover-forming body 8 which are opposite to the hinge pin 6 form means for locking the stem 4-active head 1 assembly in the active position of the utensil once the cover-forming body 8 is folded back on body 7. Indeed, in so far as the extreme part of stem 4 is imprisonned between the extreme side walls 8*b*2, it cannot move any more in a plane perpendicular to the longitudinal median plane of the holder-forming body 7. The end part of the upper wall 8*a* of body 8 comprises one circular through opening 8*a*1 for the passage of the circular head 9*a* of the pivoting pin 9 in the folded position of body 8 on the holder-forming body 7 and rests on the end part of stem 4 in this position. The end wall 8*c* of body 8 comprises one opening 8*c*1 for the passage of the end wall 7*c* in order to ensure the pivoting of the cover-forming body 8 with respect to the holder-forming body 7. The hinge pin 6 consists for example of two small outer projections (not shown) solid with the side walls 7*b* of body 7 and located along an axis perpendicular to the longitudinal median plane of body 7 and of two small holes (not shown) located respectively in the corners at right angle of the side walls 8*b* adjacent to body 7 and through which the two outer projections 6 of body 7 fit respectively.

The conversion of the utensil from one to the other of the two active and passive configurations proceeds very easily as follows.

In FIG. 1, the stem 4-active head 1 assembly is locked at the end part of stem 4 inside the handhold 5 in the prolongation of the same, thus maintaining the utensil in its active position of use.

When the handle is seized at the recesses 8*b*1 and the projections 7*b*2, one just has to separate the cover-forming body 8 from the holder-forming body 7 as shown by arrow A in FIG. 1 to open the cover-forming body 8 and to thus unlock the stem 4-active head 1 assembly, the body 8 being moved apart up to the position represented in FIG. 3 so as to totally free the opening 7*b*1 of body 7. The stem 4-active head 1 assembly is then displaced as shown by arrow B in FIG. 2 about the pivoting pin 9 in the plane perpendicular to the longitudinal median plane of body 7 to arrive at the position illustrated in FIG. 3 in which the brushing bristles 2, after having passed through the opening 7*b*1, are lodged in the hollow part of body 7, the stem 4 and the head 1 in the prolongation of the former being in line with the longitudinal axis of body 7 directly above the opening of the latter. The cover-forming body 8 is then folded back on body 7 so as to totally conceal the stem 4-active head 1 assembly inside the handhold 5 thus formed. The utensil presents then the configuration illustrated in FIG. 4. In this configuration, the utensil can be transported very easily in a small volume.

The invention has been described with reference to a tooth brush as a toilet utensil. However it is clear that the invention can be applied to all toilet utensils and/or body care articles such for example as make-up brushes, lash brushes or eyebrow brushes or the like.

What is claimed is:

1. A tooth brush, comprising:

an active head formed of brushing bristles;

a handle solid with the active head, the handle comprising a stem which carries the head and a handhold connected to the stem so that the assembly formed of the head and of the stem is retractable into the handhold, wherein the handhold comprises two hollow bodies articulated with respect to each other, one body forming an open holder intended to receive the brushing bristles of the head and consisting of a bottom-forming wall and two substantially side walls and one body forming a cover folding back on the holder-forming body, and the stem being mounted in pivoting relationship about a pivoting pin of the holderforming body in a plane perpendicular to the longitudinal median plane of this body so that the assembly formed of the stem and the head can occupy an active position in the prolongation of the holder-forming body in which position said assembly is locked by folding back the cover-forming body and an inactive retracted position after folding back of the cover-forming body, and wherein said holder-forming body comprises one side opening provided through one side wall thereof for the passage of said brushing bristles of the active head, and said cover-forming body comprises near its open free end two side walls of inner width greater than the outer width of the sidewalls of the holder forming body so that when in a folded configuration, the sidewalls of the cover forming body serve both to prevent inadvertent deployment of the active head from its retracted position by covering the side opening in the side wall of holder forming body, and additionally to lock the stem into an extended position by securing a position of the stem between its walls so as to prevent movement of the stem about the stem's pivot.

2. A utensil according to claim 1, wherein the pivoting pin of said stem is arranged near the free end of the holder-forming body in the longitudinal median plane of the same and is solid with an even part of said body serving as a support for the end part of the stem.

3. A utensil according to claim 2, wherein said even support part of the holder-forming body comprises one projection co-operating with two corresponding recesses located under the end part of the stem in order to position respectively the stem into the prolongation of the holder-forming body before folding of the cover-forming body and to position the stem in the retracted position in the holder-forming body before folding of the cover-forming body.

4. A utensil according to claim 1, wherein the stem comprises one side groove in which said pivoting pin is inserted and which renders the assembly formed of the stem and of the head removable from the body.

5. A tooth brush according to claim 1, wherein the aforesaid pivoting pin comprises at its free end a circular head for attaching the end part of the stem to the holder-forming body.

6. A utensil according to claim 1, wherein the end part of the upper wall of the cover-forming body comprises an opening for the passage of the circular head of the aforesaid pivoting pin and rests on the end part of the aforesaid stem in the folded position of the cover-forming body so as to further secure the assembly in its extended configuration.

* * * * *